US008381565B2

(12) United States Patent
Zander

(10) Patent No.: US 8,381,565 B2
(45) Date of Patent: Feb. 26, 2013

(54) MULTIFUNCTIONAL MULTIPOSITIONAL PRECISION HAND MECHANICAL RIVET SETTING DEVICE

(76) Inventor: Carl Alfred Zander, Fort Myers Beach, FL (US)

( * ) Notice: Subject to any disclaimer, the term of this patent is extended or adjusted under 35 U.S.C. 154(b) by 242 days.

(21) Appl. No.: 12/932,534

(22) Filed: Feb. 28, 2011

(65) Prior Publication Data

US 2011/0214268 A1 Sep. 8, 2011

Related U.S. Application Data

(60) Provisional application No. 61/339,397, filed on Mar. 4, 2010.

(51) Int. Cl.
*B25C 11/00* (2006.01)
*B23P 11/00* (2006.01)

(52) U.S. Cl. ..... 72/412; 72/114; 72/391.8; 72/454; 72/472; 29/243.53

(58) Field of Classification Search ..... 72/114, 72/391.8, 412, 454, 459, 472, 477, 479; 29/243.53, 29/243.54

See application file for complete search history.

(56) References Cited

U.S. PATENT DOCUMENTS

| | | | | | |
|---|---|---|---|---|---|
| 1,722,793 | A | * | 7/1929 | Hanna | 72/429 |
| 1,767,946 | A | * | 6/1930 | Scott | 72/453.17 |
| 2,139,639 | A | * | 12/1938 | MacConochie | 72/445 |
| 3,234,634 | A | * | 2/1966 | Johnson et al. | 29/243.54 |
| 3,412,597 | A | * | 11/1968 | Rains | 72/454 |
| 3,747,194 | A | * | 7/1973 | Christensen | 29/243.54 |
| 3,933,019 | A | | 1/1976 | Underland | |
| 3,955,395 | A | | 5/1976 | Vecchione | |
| 4,067,223 | A | | 1/1978 | Cunningham | |
| 4,602,414 | A | * | 7/1986 | Bartholomew et al. | 29/243.54 |
| 4,693,406 | A | | 9/1987 | Bartholomew | |
| 4,988,031 | A | * | 1/1991 | Jordan | 72/412 |
| 5,771,738 | A | | 6/1998 | Ko | |
| 6,115,900 | A | | 9/2000 | Cerulo | |

* cited by examiner

*Primary Examiner* — David B Jones

(57) ABSTRACT

A hand and mechanically activated rivet setting device uniquely and integrally designed to set multiple different types of rivets comprising tubular, semi-tubular and solid rivets made entirely or in part from aluminum, brass, steel and stainless steel having multiple different kinds of heads comprising truss, dome and flat rivet heads; in a work product consisting of pieces and components to be riveted together. The device has the means to set rivets from different positional locations within the device and provides the device operator the ability to completely control the rivet setting process, assuring precision rivet setting without damaging the pieces or components being riveted.

18 Claims, 3 Drawing Sheets

MULTIFUNCTIONAL MULTIPOSITIONAL PRECISION HAND MECHANICAL RIVET SETTING DEVICE

CROSS-REFERENCE TO RELATED APPLICATIONS

This application claims the benefit of and priority to Provisional Application, Application No. 61/339,397, filed on Mar. 4, 2010 by the present inventor and titled Automotive Precision Rivet Tool.

FIELD OF THE INVENTION

The invention relates to a multifunctional, multipositional hand, mechanical rivet setting device which accomplishes precision setting of aluminum, brass, steel and stainless steel; tubular, semi-tubular and solid rivets having truss, dome and flat rivet heads.

BACKGROUND OF INVENTION

Thousands of products and assemblies, especially those in the consumer durable market, have their components fabricated together with various types of rivets, such as, tubular, semi-tubular and solid rivets made from aluminum, brass steel and stainless steel and having various types of rivet heads, such as, truss, dome and flat heads. Servicing these products and assemblies most often requires drilling out the existing rivets that hold the components together in order to gain access to the areas that need servicing. Primary examples of such products and assemblies are found in the automobile market, especially in the area of classic or historic automobiles dating up through the mid 1980's. Automotive fiberglass heater boxes; metal and felt window channels; metal and plastic air ventilation flaps; and metal and nylon rear axle rebound straps are some examples. After servicing, the components of the assembly must be riveted back together. Hand impact and lever type rivet setting tools are typically single stroke or single motion tools and typically can only function with one type of rivet, such as, tubular or solid; made of only one type of material, such as, aluminum or steel; having only one type of rivet head, such as, truss or flat. In addition, on a functional basis, these tools can only set a rivet from one position within the tool and have difficulty functioning or are unable to function within limited space areas. These riveting tools often mis-set the rivet, damage the rivet shaft or head and most significantly damage the component(s) being riveted together, such as in the case of riveting fiberglass or plastic components. This can result in major repairs to the component(s) or completely discarding the component(s), in turn, resulting in a significant expense. Accordingly, it would be very desirable and extremely beneficial to provide a unique hand, mechanical rivet setting device that would be multifunctional in that it would be able to set various types of rivets, such as, tubular, semi-tubular and solid; being made entirely or in part of aluminum, brass, steel or stainless steel and having various types of heads, such as, truss, dome and flat; that would be multipositional in that it can set rivets from more than one position within the device; that would be able to function within limited space areas; and that would allow the operator to fully control the device so that the rivet would be set with precision, thus eliminating any damage to the rivet or the component(s) being riveted.

SUMMARY OF THE INVENTION

The invention is a hand, mechanical precision rivet setting device uniquely designed and configured to set tubular, semi-tubular and solid rivet types made entirely or in part of aluminum, brass, steel or stainless steel material and having either a truss, dome, or flat rivet head. The device provides for the precision setting of rivets in such a manner so as not to damage or adversely distort the rivet or the components being riveted together. The device is light in weight, of a compact design and can function within restricted space areas. The device comprises a body which has a driveshaft end containing a threaded aperture and a base end containing a threaded aperture; a specially designed driveshaft having a non-threaded aperture for the insertion of one of a multiple number of different tips; a uniquely designed and configured set of non-threaded driveshaft tips for setting rivet shafts and holding rivet heads; and a uniquely designed and configured set of threaded bases for the body providing for setting rivet shafts and holding rivet heads. The device is multipositional in its ability to set rivets, in that a rivet can be set from either the driveshaft end or the base end of the body of the device. The driveshaft is inserted into the threaded aperture of the driveshaft end of the body of the device and partially rotated down. Depending whether the rivet is to be set from the driveshaft end or the base end of the body of the device, either a rivet shaft setting tip or a rivet head holding tip is inserted into the non-threaded aperture of the drive shaft. Correspondingly, either a rivet setting base or a rivet head holding base is inserted into the threaded aperture in the base end of the body of the device and rotated down to a desired position. A rivet is placed into the component to be riveted and the rivet setting device is appropriately placed over the rivet and component so that the rivet head is in position to be held and the rivet shaft is in position to be set. The device driveshaft is rotated down using a socket and ratchet wrench until the rivet shaft is set to the desired configuration. Since the rivet setting process is not dependent on a single impact stroke or lever action, but rather controlled rotation, the device can be removed, multiple times if needed, from the rivet and the rivet can be examined to see if the desired setting configuration has been achieved, and if it has not, the device can be re-positioned over the rivet and component and the rivet setting process can continue until the precise rivet setting configuration is obtained.

It is an advantage and a benefit of the present invention that the present device is multifunctional in that it will set, through using uniquely designed and configured, interchangeable and replaceable tips and bases, different types of rivets, comprising tubular, semi-tubular and solid rivets.

It is an advantage and a benefit of the present invention that the present device can set rivets made of different types of materials, comprising rivets made entirely or in part of aluminum, brass, steel and stainless steel.

It is an advantage and a benefit of the present invention that the present device is multifunctional in that it can set rivets having multiple different types of heads, through using uniquely designed and configured, interchangeable and replaceable tips and bases, comprising truss, dome and flat head rivets.

It is an advantage and a benefit of the present invention that the present device has the means to set rivets from multiple positions within the device, specifically, the driveshaft end of the body of the device or the base end of the body of the device.

It is an advantage and a benefit of the present invention that the present device has bases that can be adjusted up or down to different heights to allow access to a rivet that is in a channel, recess or hole.

It is an advantage and a benefit of the present invention that the present device provides for the precision setting of rivets through allowing the operator of the device to completely control the movement of the device's driveshaft which produces the pressure to set the rivet.

It is an advantage and a benefit of the present invention that the present device is light in weight and compact in design allowing it to be readily moved to and placed on the rivet of the work piece that is to be set and to allow it to function within restricted space areas.

Additional advantages, benefits, objects and features of the present invention will become more apparent from the following specification of the preferred embodiments.

BRIEF DESCRIPTION OF THE DRAWINGS

The present invention will be more fully understood by reference to the specification of the preferred embodiment when read in conjunction with the accompanying drawings in which the reference numbers refer to like parts throughout the several views.

DETAILED DESCRIPTION OF THE PREFERRED EMBODIMENTS

Figure 1:
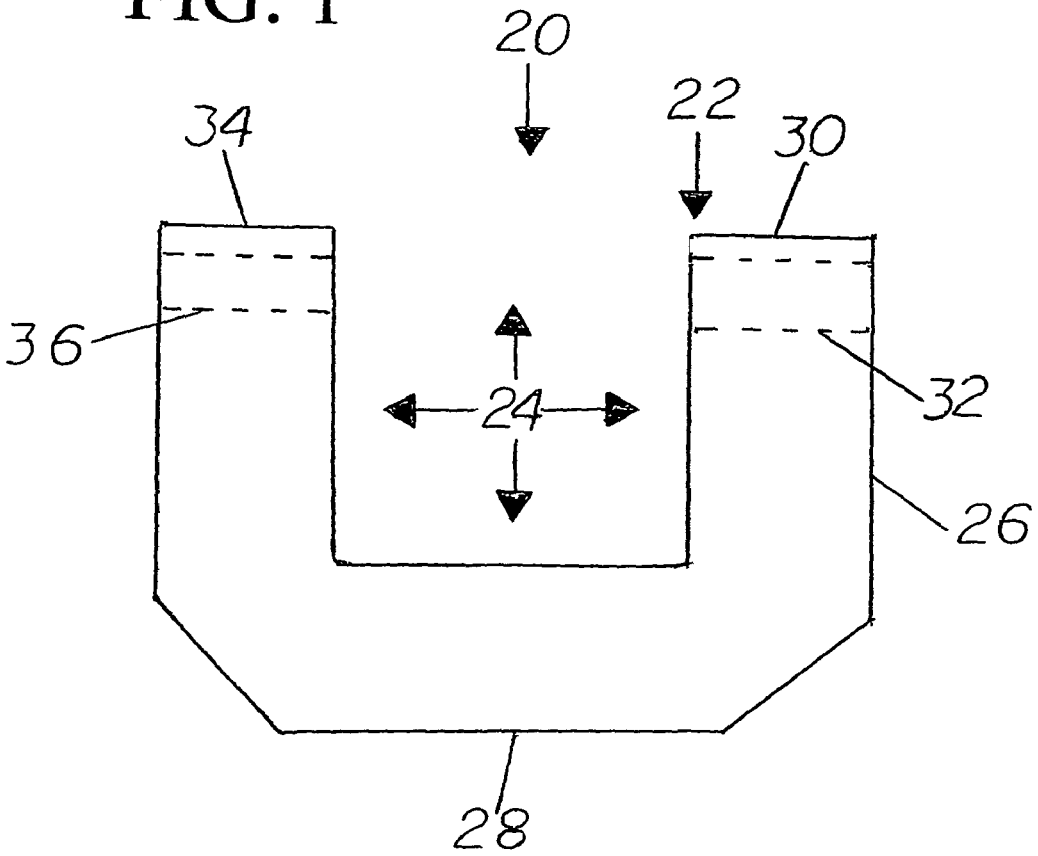
FIG. 1 is an orthogonal front view of the body of the rivet setting device in accordance with the present invention.
Figure 2:
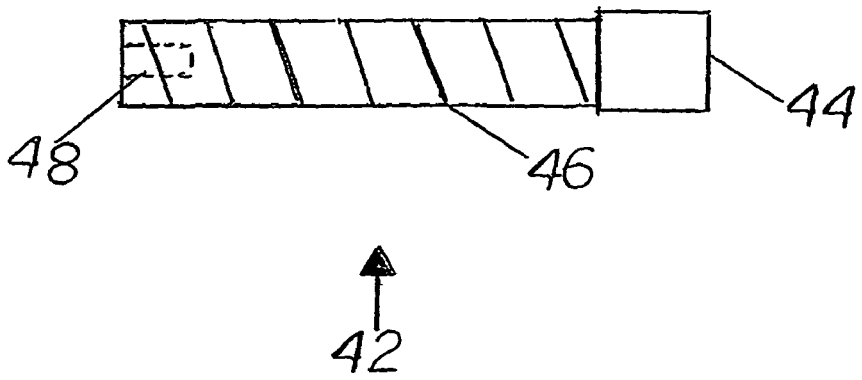
FIG. 2 is an orthogonal side view of the driveshaft of the rivet setting device in accordance with the present invention.
Figure 5:
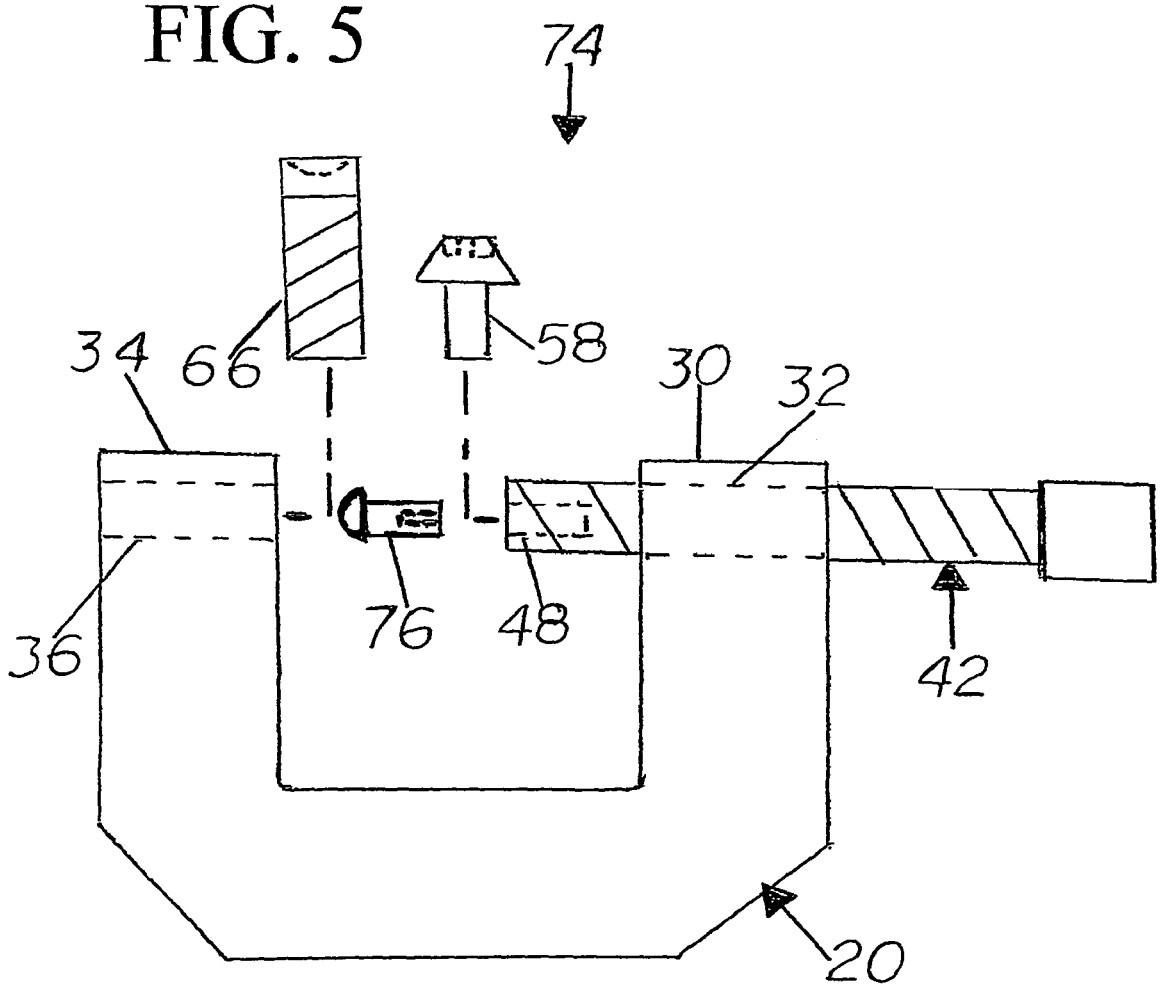
FIG. 5 is an orthogonal front view of the rivet setting device showing the interrelationships of the driveshaft attached to the body, a tip to the driveshaft, a base to the body and the device to a rivet to be set in accordance with the present invention.

As depicted in FIG. 1 and FIG. 2 and FIG. 5 the rivet setting device comprises a body 20 which has a top 22, a bottom 28, a pair of sides 26, a driveshaft end 30, a base end 34 and a throat opening 24. The width of the body 20 between the top 22 and the bottom 28 can vary from approximately two inches to approximately eight inches. The length of the body 20 between the pair of sides 26 can vary from approximately three inches to approximately nine inches. The thickness of the body 20 can vary from approximately one half inch to approximately one inch. The throat opening 24 of the body 20 can vary in size from approximately one inch by one inch to approximately seven inches by seven inches. The body 20 has a threaded base aperture 36 and a threaded driveshaft aperture 32. The driveshaft has a head 44, a threaded shaft 46 and a non-threaded tip aperture 48. The driveshaft 42 is received by the threaded driveshaft aperture 32 of the body 20.

Figure 3:
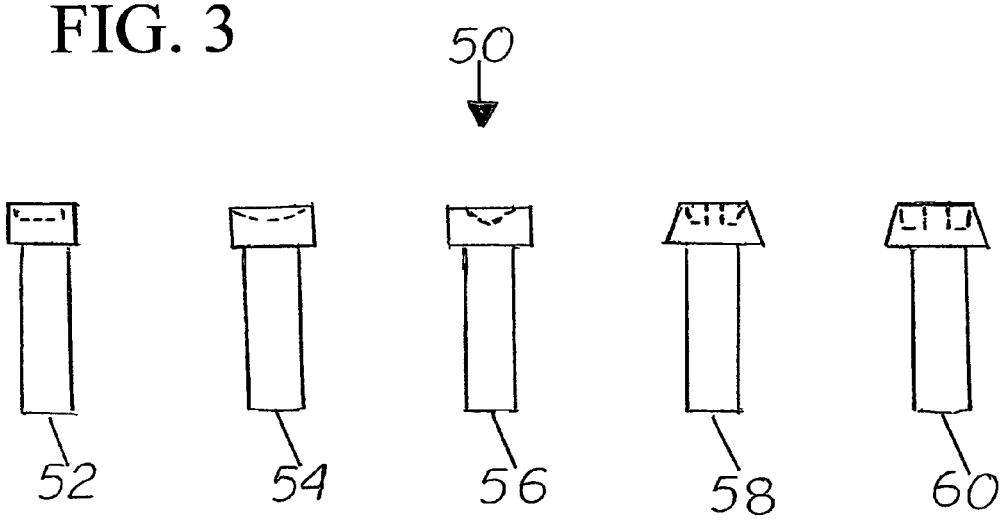
FIG. 3 is an orthogonal side view of the rivet shaft setting tips and rivet head holding tips of the driveshaft of the rivet setting device in accordance with the present invention.

As shown in FIG. 3 and FIG. 5 the non-threaded tip aperture 48 of the driveshaft 42 can receive one of a multiple number of uniquely configured rivet setting and rivet head holding tips from a tip set 50. The tip set 50 comprises a flat head rivet, rivet head holding tip 52; a truss and dome head rivet, rivet head holding tip 54; a solid rivet blunting setting tip 56; a tubular and semi-tubular rivet fold over setting tip 58 for small diameter rivets; and a tubular and semi-tubular rivet fold over setting tip 60 for large diameter rivets.

Figure 4:
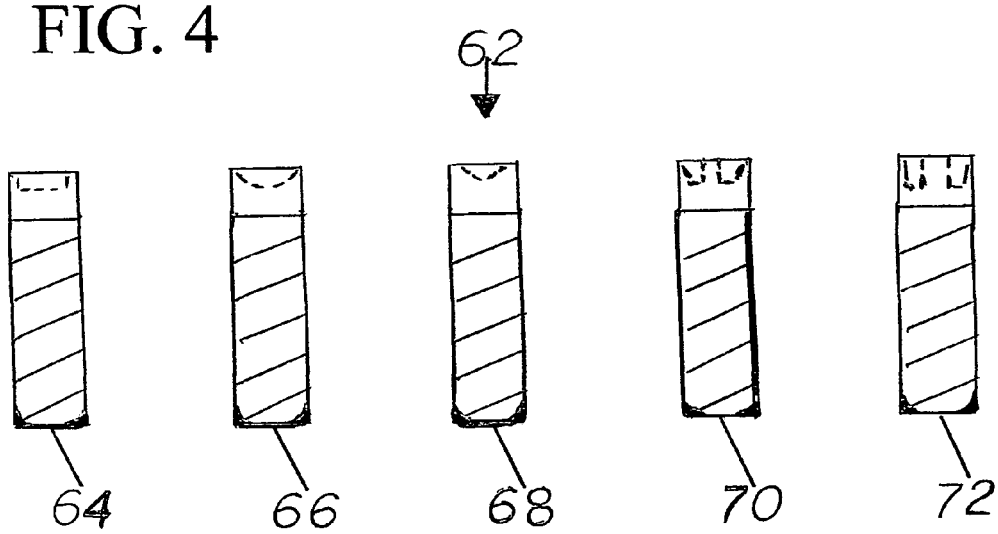
FIG. 4 is an orthogonal side view of the rivet shaft setting bases and rivet head holding bases of the base end of the body of the rivet setting device in accordance with the present invention.

As depicted in FIG. 4 and FIG. 5 the threaded aperture 36 of the body 20 can receive one of a multiple number of uniquely configured rivet setting and rivet head holding threaded bases from a base set 62. The base set 62 comprises a flat head, rivet holding base 64; a truss and dome head rivet, rivet head holding base 66; a solid rivet blunting setting base 68; a tubular and semi-tubular rivet fold over setting base for small diameter rivets 70; and a tubular and semi-tubular rivet fold over setting base 72 for large diameter rivets.

Figure 6:
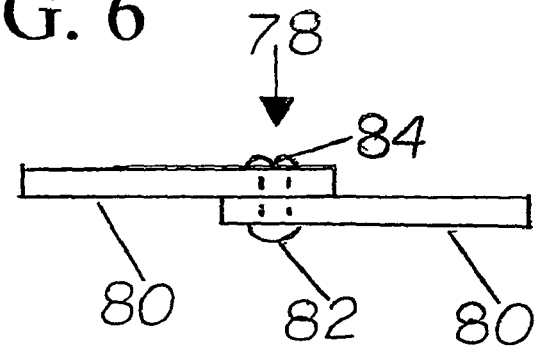
FIG. 6 is a perspective side view of a riveted component, comprising two pieces of material, riveted together by the rivet setting device using a truss head, semi-tubular rivet in accordance with the present invention.

As shown in FIG. 5 and FIG. 6 a truss head 82 semi-tubular rivet 76 is to be set from the driveshaft end 30, as opposed to the alternative base end 34, of the body 20 of the rivet setting device 74. The truss and dome head rivet head holding base 66 is inserted into the threaded base aperture 36 of the body 20 and turned down to the desired height. The driveshaft 42 is inserted into the threaded driveshaft aperture 32 of the body 20 and turned down the desired distance. The semi-tubular rivet fold over setting tip 58, for small diameter rivets, is inserted into the non-threaded tip aperture 48 of the driveshaft 42. The rivet 76 is inserted through holes in the material pieces 80 that are to be riveted together which will form a riveted a riveted component 78. The component 78 with an inserted rivet 76 is placed into the rivet setting device 74 so that the rivet 76 is aligned between the truss and dome head rivet head holding base 66 and the semi-tubular rivet fold over setting tip for small diameter rivets 58. The drive shaft 42 is turned down to the point where a precisely set, folded over, rivet shaft end 84 is produced. The driveshaft 42 is backed off and the riveted component 78 is removed from the rivet setting device 74.

While the rivet setting device 74 as shown in FIG. 5 can be made from several different materials using several different manufacturing processes, the selected materials and manufacturing process are 6061-T6 billet aluminum and 4140 hardened steel that are machined, using computer numerically controlled equipment. By using these materials the rivet setting device 74 is light, durable and very rigid and can accept a variety of different finishes including powder coating, anodizing, plating and polishing.

Accordingly, from the description above it is apparent that my hand, mechanical rivet setting device, the present invention, has many advantages and benefits which include the following. First, the device is multifunctional in that it will set tubular, semi-tubular and solid types of rivets through the use of uniquely configured, removable, interchangeable and replaceable tips and bases. Second, the device is multifunctional in that it can set rivets made entirely or in part of aluminum, brass, steel and stainless steel. Third, the device is multifunctional in that it can set rivets having truss, dome and flat heads through the use of uniquely configured, removable, interchangeable and replaceable tips and bases. Fourth, the device can set rivets from multiple locations within the device, those being the drive shaft location and the base location of the device. Fifth, the device bases can be adjusted up or down to different heights to allow access to rivets located within channels, recesses and holes. Sixth, the device provides for the precision setting of rivets without damaging the rivet or the material being riveted together by allowing the operator of the device to completely control the movement of the device's driveshaft which produces the pressure to set the rivet. Seventh, the device is light and compact allowing it to be readily moved to and place on the rivet to be set and to function within restricted space areas. Eight, the tips and bases of the device are removable, interchangeable and replaceable. Ninth, the device can accept a variety of different finishes including powder coating, anodizing, plating and polishing. These advantages and benefits of my invention should not be construed as limiting the scope of my invention, but merely presenting some of the many advantages and benefits of my invention.

Having disclosed my invention, many other modifications may be apparent to those skilled in the art to which it pertains without deviation from the spirit of the invention as defined by the scope of the appended claims.

I claim:

1. A rivet setting device, that is hand and mechanically activated, having the means to set different types of rivets comprising, tubular, semi-tubular and solid rivets made entirely or in part of aluminum, brass, steel and stainless steel having truss, dome and flat heads; in a work product comprising pieces and components to be riveted together; said rivet setting device comprising:

a body having a top and a bottom extending between a pair of sides, said body having a threaded aperture for receiving a threaded driveshaft and a threaded aperture for receiving rivet setting and rivet head holding threaded bases; and a said threaded driveshaft that is received into said threaded aperture for said threaded driveshaft in said body, said threaded driveshaft having a head that provides a means for rotating said threaded driveshaft to accomplish the rivet setting process and a non-threaded aperture for receiving rivet setting and rivet head holding non-threaded tips; and a set of said rivet setting and rivet head holding threaded bases that are received, on an individual basis, into said threaded aperture for receiving rivet setting and rivet head holding threaded bases of said body; and a set of said rivet setting and rivet head holding non-threaded tips that are received, on an individual basis, into said non-threaded aperture for receiving rivet setting and rivet head holding non-threaded tips of said driveshaft.

2. The rivet setting device of claim 1, wherein said body has a throat area that extends between said sides of said body and said bottom and said top of said body, said throat area being open at said top of said body; said throat area being able to receive a work product comprising pieces and components to be riveted together.

3. The rivet setting device of claim 1, wherein said threaded drive shaft is removable from said body and is replaceable.

4. The rivet setting device of claim 1, wherein said threaded drive shaft is completely controllable by the operator of said rivet setting device providing said operator with the ability to apply only the necessary amount of rivet setting pressure, by simple rotational movement of the said drive shaft, to appropriately and precisely set the rivet without damaging the pieces and components of the work product that are being riveted together.

5. The rivet setting device of claim 1, wherein said rivet setting and rivet head holding threaded bases, of said set of rivet setting and rivet head holding threaded bases, are height adjustable, interchangeable, removable and replaceable and are able to set rivets comprising tubular, semi-tubular and solid rivets made entirely or in part of aluminum, brass, steel and stainless steel and hold rivet heads comprising truss, dome and flat rivet heads.

6. The rivet setting device of claim 1, wherein said rivet setting and rivet head holding non-threaded tips, of said set of rivet setting and rivet head holding non-threaded tips, are interchangeable, removable and replaceable and are able to set rivets comprising tubular, semi-tubular and solid rivets made entirely or in part of aluminum, brass, steel and stainless steel and hold rivet heads comprising truss, dome and flat rivet heads.

7. The rivet setting device of claim 1, wherein said rivet setting device has the ability to set a rivet or hold a rivet head from either a said rivet setting and rivet head holding threaded base or a said rivet setting and rivet head holding non-threaded tip.

8. The rivet setting device of claim 1, wherein said rivet setting device has the means to set rivets that are positioned in channels, recesses and holes.

9. The rivet setting device of claim 1, wherein said rivet setting device is light in weight and has a compact configuration providing said rivet setting device the ability to function in restricted space areas.

10. A rivet setting device, having hand and mechanical activation and having the means to set multiple different types of rivets made entirely or in part of multiple different materials and having multiple different kinds of heads; in a work product comprising pieces and components to be riveted together; said rivet setting device comprising a body having a top and a bottom extending between a pair of sides, said body having a threaded aperture for receiving a threaded driveshaft and a threaded aperture for receiving rivet setting and rivet head holding threaded bases; and a said threaded driveshaft that is received into said threaded aperture for said threaded driveshaft in said body, said threaded driveshaft having a head that provides a means for rotating said threaded driveshaft to accomplish the rivet setting process and a non-threaded aperture for receiving rivet setting and rivet head holding non-threaded tips; and a set of said rivet setting and rivet head holding threaded bases that are received, on an individual basis, into said threaded aperture for receiving rivet setting and rivet head holding threaded bases of said body; and a set of said rivet setting and rivet head holding non-threaded tips that are received, on an individual basis, into said non-threaded aperture for receiving rivet setting and rivet head holding non-threaded tips of said driveshaft.

11. The rivet setting device of claim 10, wherein said body has a throat area that extends between said sides of said body and said bottom and said top of said body, said throat area being open at said top of said body; said throat area being able to receive a work piece comprising material pieces and components to be riveted together.

12. The rivet setting device of claim 10, wherein said threaded drive shaft can be removed from said body and can be replaced.

13. The rivet setting device of claim 10, wherein said threaded drive shaft is completely under the control of the operator of said rivet setting device providing said operator with the means to apply only the necessary amount of rivet setting pressure, by simple rotational movement of the said drive shaft, to appropriately and precisely set the rivet without damaging the material pieces and components of the work piece that are being riveted together.

14. The rivet setting device of claim 10, wherein said rivet setting and rivet head holding threaded bases, of said set of rivet setting and rivet head holding threaded bases, are height adjustable, interchangeable, removable and replaceable and have the means to set rivets comprising tubular, semi-tubular and solid rivets made entirely or in part of aluminum, brass, steel and stainless steel and to hold rivet heads comprising truss, dome and flat rivet heads.

15. The rivet setting device of claim 10, wherein said rivet setting and rivet head holding non-threaded tips, of said set of rivet setting and rivet head holding non-threaded tips, are interchangeable, removable and replaceable and have the means to set rivets comprising tubular, semi-tubular and solid rivets made entirely or in part of aluminum, brass, steel and stainless steel and to hold rivet heads comprising truss, dome and flat rivet heads.

16. The rivet setting device of claim 10, wherein said rivet setting device has the means to set a rivet or hold a rivet head from either a said rivet setting and rivet head holding threaded base or a said rivet setting and rivet head holding non-threaded tip.

17. The rivet setting device of claim 10, wherein said rivet setting device has the means to set rivets that are positioned in channels, recesses and holes.

18. The rivet setting device of claim 10, wherein said rivet setting device is light in weight and possesses a compact configuration providing said rivet setting device the means to function in restricted space areas.

* * * * *